US005915510A

United States Patent [19]

Dinkelmann et al.

[11] Patent Number: 5,915,510

[45] Date of Patent: Jun. 29, 1999

[54] SILVER COMPACTOR IN THE STRETCHING FRAME OF A SPINNING MACHINE

[75] Inventors: Friedrich Dinkelmann, Rechberghausen; Stefan Krawietz, Ebersbach/Fils, both of Germany

[73] Assignee: Zinser Textilmaschinen GmbH, Ebersbach/Fils, Germany

[21] Appl. No.: 09/118,622

[22] Filed: Jul. 17, 1998

[30] Foreign Application Priority Data

Jul. 17, 1997 [DE] Germany ..... 197 30 763
Dec. 18, 1997 [DE] Germany ..... 197 56 394

[51] Int. Cl.[6] ..... D01H 5/72

[52] U.S. Cl. ..... 19/288; 19/246; 19/266; 57/315

[58] Field of Search ..... 19/288, 236, 244, 19/246, 266, 273, 287, 291; 57/315, 328

[56] References Cited

U.S. PATENT DOCUMENTS 4,445,252 5/1984 Morihashi et al. ..... 19/244
5,431,005 7/1995 Fehrer ..... 57/315
5,577,298 11/1996 Morell ..... 19/291
5,704,096 1/1998 Lang ..... 19/291

OTHER PUBLICATIONS

SKF Kugellagerfabriken GmbH, Jan. 13, 1959; "Luntenverdichter fur Spinnereimaschinen–Streckwerke"; No. 804.03, 5 pages.

SKF Kugellagerfabriken, Dec. 2, 1960; "Verdichter fur Spinnereimaschinen–Streckwerke", N.804.10, 5 pages.

*Primary Examiner*—Michael A. Neas
*Assistant Examiner*—Gary L. Welch
*Attorney, Agent, or Firm*—Herbert Dubno

[57] ABSTRACT

To allow the gap between a pair of belts and the output pair of rollers of a drafting frame for a textile machine to be reduced, the sliver compaction funnel which is disposed at the inlet side of the nip of the output pair of rollers is mounted on an arm which extends alongside the upper rollers or upper belt. The funnel can be mounted on two arms which straddle the ends of the upper roller or upper belt.

9 Claims, 3 Drawing Sheets

1
9
5
10
2
5
12
13
4
8
4
7
3
6
17
15
5
14
4
11

SILVER COMPACTOR IN THE STRETCHING FRAME OF A SPINNING MACHINE

FIELD OF THE INVENTION

The present invention relates to a sliver compactor of a drafting frame for a spinning machine or a spin twister or like textile machine and, more particularly, to a drafting frame in which, for each sliver fed to a spinning spindle, the sliver passes between upper and lower belts of the drafting frame and into the nip of a pair of output rollers through a sliver compactor which includes a sliver funnel converging in the direction of the nip.

BACKGROUND OF THE INVENTION

The compaction of the sliver fed to a spinning spindle of a spinning machine, spin twister or like textile machine is described in DE 1 825 759 U and in this system the two funnel-forming elements are connected via respective ribs to bushings which are rotatable upon a journalling rod. To accommodate the funnel to the various changes in the sliver, the funnel not only is swingable on the rod but can to a limited extent be axially shiftable thereon. However, since the funnel and its carrier ribs or portions must be located in the gap between the upper belt and the upper roller of the pair of the output rollers, this distance must be sufficient to accommodate the mount for the compaction funnel. Because of the increased spacing to accommodate the support for the compaction funnel, the control of the stretch in the stretching zone is reduced and the quality of the yarn is adversely effected.

OBJECTS OF THE INVENTION

It is, therefore, the principal object of the present invention to provide a drafting frame for a textile machine for the spinning of sliver, which can provide for the compaction of the sliver without enlargement of the spacing between the belt pair and the output pair of rollers and especially the clamping line or plane at which the sliver is engaged by that output pair of rollers.

Another object of the invention is to provide a system for mounting a compaction funnel of a drafting frame whereby the spacing between the point at which the sliver is engaged by the output pair of rollers and the point at which the sliver leaves the belt pair of the drafting frame is minimal.

Still another object of the invention is to provide an improved drafting frame with compaction funnels for the sliver entering between the output pair of rollers, whereby drawbacks of prior art systems are obviated.

SUMMARY OF THE INVENTION

These objects and others which will become apparent hereinafter are attained, in accordance with the invention, by so mounting the funnel adopted to be located at the upstream side of the nip of the output pair of rollers of a drafting frame, downstream from the pair of belts thereof, that the mounting arm is located outwardly of an end of the upper roller of that pair or outwardly of a side of the belt pair feeding the sliver to that pair of rollers. Since the mounting arm is located laterally of the upper belt and/or the upper roller, the additional space between the belt pair and roller pair which had to be provided in the past is not necessary with the system of the invention.

DE 1 785 119 indeed has a one piece compaction funnel support formed by a U-shaped stirrup of wire on the cage of the upper belt, but this system does not allow swinging of the sliver compactor about a rod parallel to the rollers as is essential to the present case.

According to a feature of the invention and in a preferred embodiment, the compaction funnel is provided from two independently swingable parts which together form the sliver compactor. In many cases, however, the compaction funnel can be formed in one piece, i.e. in a body formed on the arm or formed with two arms which straddle the upper roller and/or the upper belt.

In the preferred embodiment, each part of the compaction funnel has a respective mounting arm and the mounting arms straddle the opposite ends of the upper roller on sides of the upper belt. Where the compaction funnels are formed in one piece, a single arm can be provided located to one or the other side of the respective upper roller or upper belt, or pairs of arms can be provided for each funnel straddling which upper roller or upper belt. Preferably the arms are located along outer ends of upper rollers of twinned systems, i.e. to the right side of one and the left side of the other upper roller.

A one piece funnel can have one or more funnel openings provided with downwardly open slits through which the sliver can be inserted into the funnel opening, the body being formed with guide edges converging toward the slit. A partition can connect this body with the journalling bushing. The partition prevents passage of the sliver over the funnel body to the output pair of rollers.

More particularly, a drafting frame with sliver compaction according to the invention can comprise:

- a support mounted upon a textile machine;
- at least one loading arm swingably mounted on the support and extending above the support;
- a lower belt on the support and an upper belt on the arm for entraining at least one sliver between the belts;
- a pair of rollers downstream of the belts and including a lower roller on the support and an upper roller on the arm for engaging sliver from the belts at a nip of the roller;
- a sliver compaction funnel receiving sliver from the belts and feeding the sliver into the nip at an upstream side thereof, the funnel converging in a direction of displacement of the sliver between the rollers; and
- means for mounting the sliver compaction funnel on the loading arm and including a mounting rod extending transversely to the direction and at least one mounting arm swingable on the rod, extending laterally of the upper roller or the upper belt and engaging the funnel.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
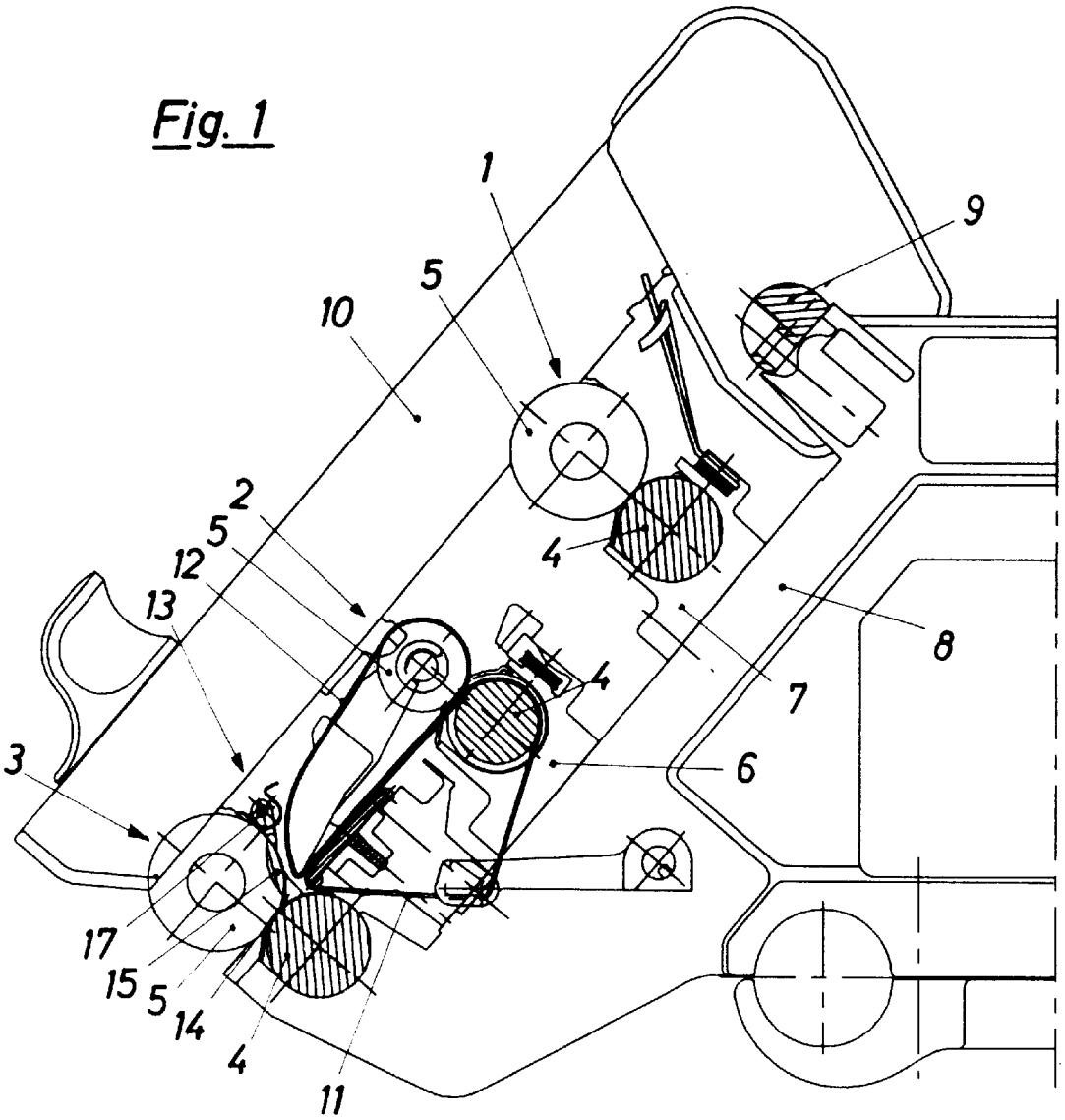
FIG. 1 is a vertical section through a stretching frame of a spinning machine provided with the sliver compactor of the present invention.

The drafting or stretching frame shown in FIG. 1 is mounted on one side of a spinning frame for the initial spinning of a roving or, as will be apparent hereinafter, for spinning and twisting sliver or rovings or for the production of a core yarn. The spinning stations with their spindles, rings, travellers and the like have not been shown. FIG. 1, therefore, shows only the important part of the drafting frame which are necessary for the understanding of the invention, it being understood that the remainder of the drafting frame and the parts thereof can be conventional in the art.

The drafting frame comprises three roller pairs 1, 2 and 3, traversed by the slivers or rovings in succession, sliver being drawn from cans of a can field or the like. The three roller pairs of the drafting frame each have a lower roller 4 which extends continuously all along the drafting frame or at least over a section thereof and for each two upper rollers 5 of the roller pairs, has a respective loading arm 10. Each of the rollers 5 serves a respective spinning station. Thus, while the lower rollers are continuous for a multiplicity of stations all along the drafting frame or even for all of the stations along a respective side of the machine, the upper rollers 5 of each pair are provided in two's, i.e. are twinned, for each two stations of the spinning frame. The lower roller 4 of the output roller pair 3 is directly journalled while the lower rollers of the other roller pairs 1 and 2 are journalled in bearing slits 6 and 7 in the bracket 8. The latter may be a stamping.

The arms 10 are hinged on support rods 9 so that they can swing upwardly from the position shown in FIG. 1 to allow the sliver to be inserted between the upper and lower rollers of the pair and the rotated arm 10 also carries the upper rollers 5 and appropriate journalling or guide elements for these upper rollers.

In the main stretching zone between the roller pairs 2 and 3 of the drafting frame, a so-called double belt unit is provided with a respective lower belt 11 and an upper belt 12 from which the sliver is fed through a sliver compactor 13 having a compaction funnel 14 converging in the direction of the nip between the upper and lower rollers 5 and 4 of the downstream roller pair 3. The funnel 14 is disposed in the inlet side or upstream side of the nip between the rollers 4 and 5. The compaction funnel 14 is engaged by at least one support arm 15 which has a journalling bushing 16 swingably mounting that arm on a rod 17 which extends traversely of the arm 10, parallel to the rollers 4,5 and transversely to the feed direction of the sliver.

As is conventional with drafting frames of this type, the belt unit serves to feed the fibers in the drafting zone as close as possible into the region that they will be gripped by the downstream roller pair 3. As a result, it is desirable to minimize the space between nip of the downstream rollers and the discharge end of the belt path and this requires elementation of the retaining arm for the funnel from the gap between the belts and the downstream pair of rollers.

To avoid increasing this gap to accommodate the retaining arm 15, the retaining arm 15 and a pair of retaining arms when the funnel is held by two of them, the retaining arms extend laterally of the upper roller 5 of the downstream pair 3 or alongside the belt 12.

Figure 2:
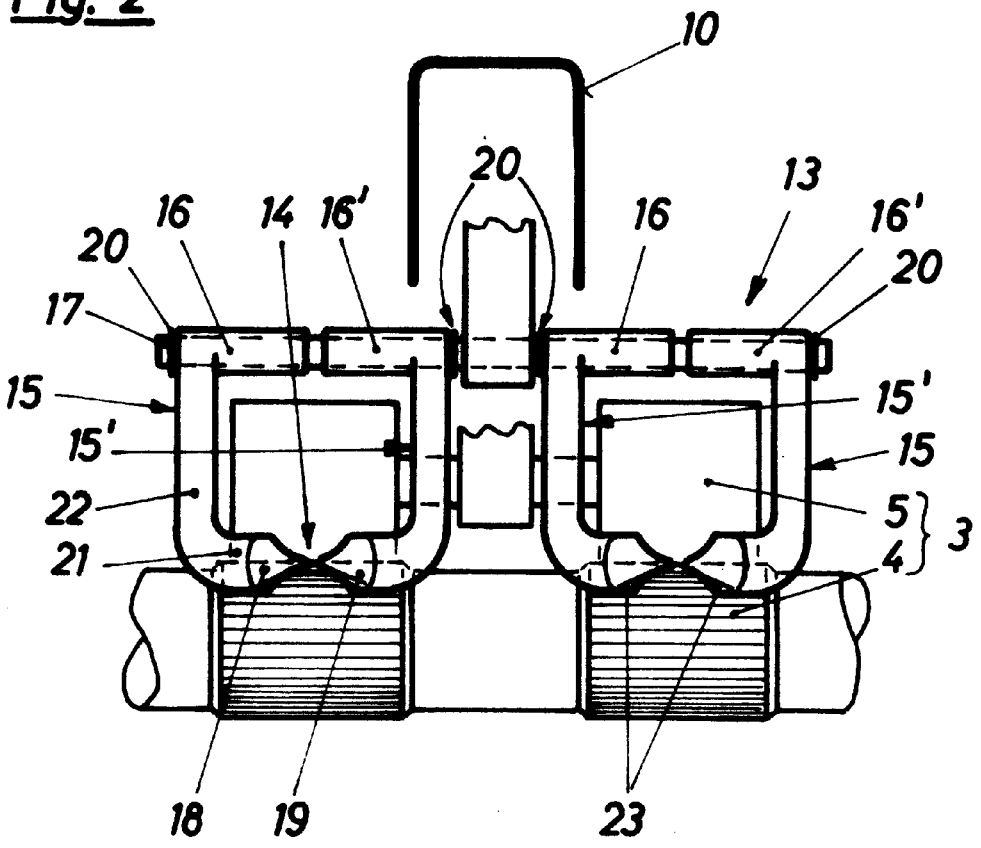
FIG. 2 is an elevational view drawn to a somewhat larger scale than FIG. 1 of a portion of the drafting frame in the travel direction of the sliver and showing a sliver compactor with a two-piece compaction funnel.
Figure 3:
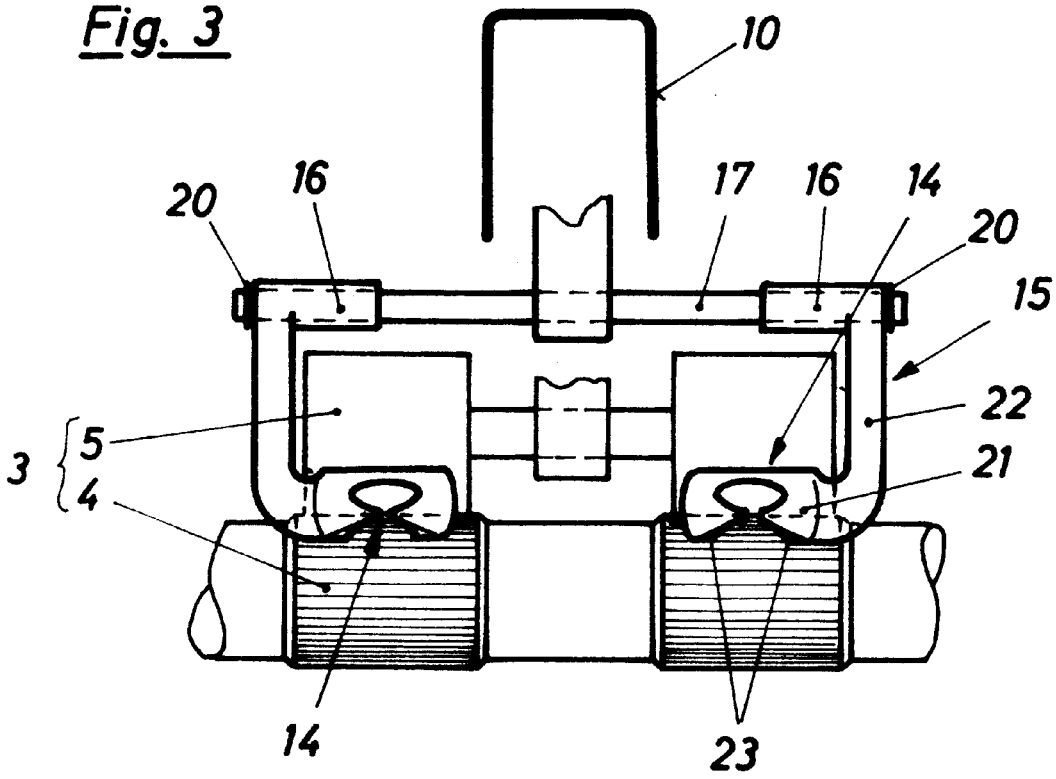
FIG. 3 is an elevational view similar to FIG. 2 but showing a sliver compactor with a one-piece compaction funnel.

As can be seen from FIGS. 2 and 3, the retaining arms 15 are angled for this purpose. In the embodiment of FIG. 2 and in a preferred embodiment, each of the compaction funnels is comprised of two funnel elements 18 and 19 which together form the compaction funnel. Each of these funnel elements is swingably mounted via a respective hold-arm 15 or 15' and journal bushing 16, 16' on the rod 17. Washers in the form of snap rings engaged in the rod 17 are provided at 20 to eliminate the axial shiftability of the bushings 16 and 16' on the bearing rod 17. Each of the holding arms 15, 15' has a first rib parallel to the rollers and which extends into the nip and a second rib 22 connecting the first rib 21 with the respective bushing 16, 16'. These second ribs 22 laterally straddle the upper roller 5 or the upper belt 12.

As has been shown in FIG. 2, the ribs 22 of the holding arm 15, 15' can be curved to extend laterally around the ends of the upper roller 5 of the roller pair 3. The ribs 22 can be linear or oppositely curved so that they can lie alongside the upper belt 12.

In the embodiment of FIG. 3, the funnels 14 are shown to be constructed in one piece and to be downwardly open. In this case, each of the funnels requires only a single holding arm which otherwise is similar to that shown in FIG. 2.

Figure 5:
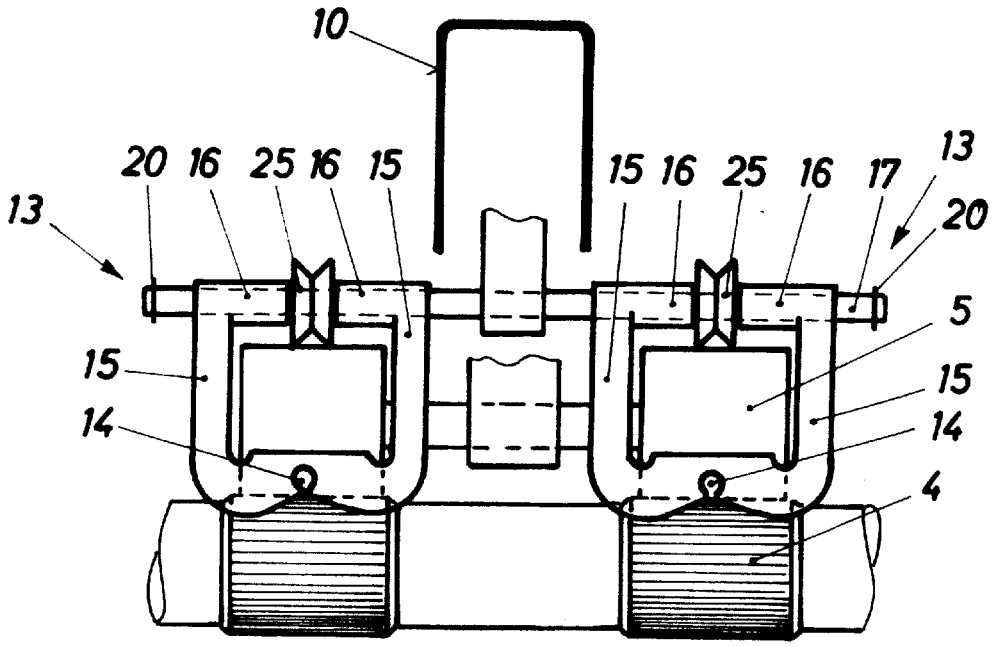
FIG. 5 is a view similar to FIGS. 2 and 4 with a sliver compactor for the production of core yarn.

In FIG. 5 we have shown funnels which are designed for the production of core yarns and, more particularly, a yarn in which a preformed core thread is fed to the machine, usually as a synthetic endless filament and fibers are spun therearound. The core thread can be introduced into the fiber sliver to be stretched in the drafting frame upstream of the output roller pair. As can be seen from FIG. 5, each one piece sliver compactor 13 is engaged by two holding arms 15, 15' having journalling bushing 16, 16' swingably mounting same on the rod 17. Between the bushing 16 and 16' a grooved roller 15 is rotatable on the rod 17 when the drafting frame is in operation.

Upon operation of the drafting frame, the compacting funnels 14 of the two sliver compactors 13 shift over part of the width of the milled region of the lower roller 4 and within this region, the grooved roll 25 is entrained by the bushings 16, 16' of the arms 15, 15' on either side of the grooved roll so that the core thread feed by the grooved roll is always delivered to the sliver as it enters the funnel.

Figure 4:
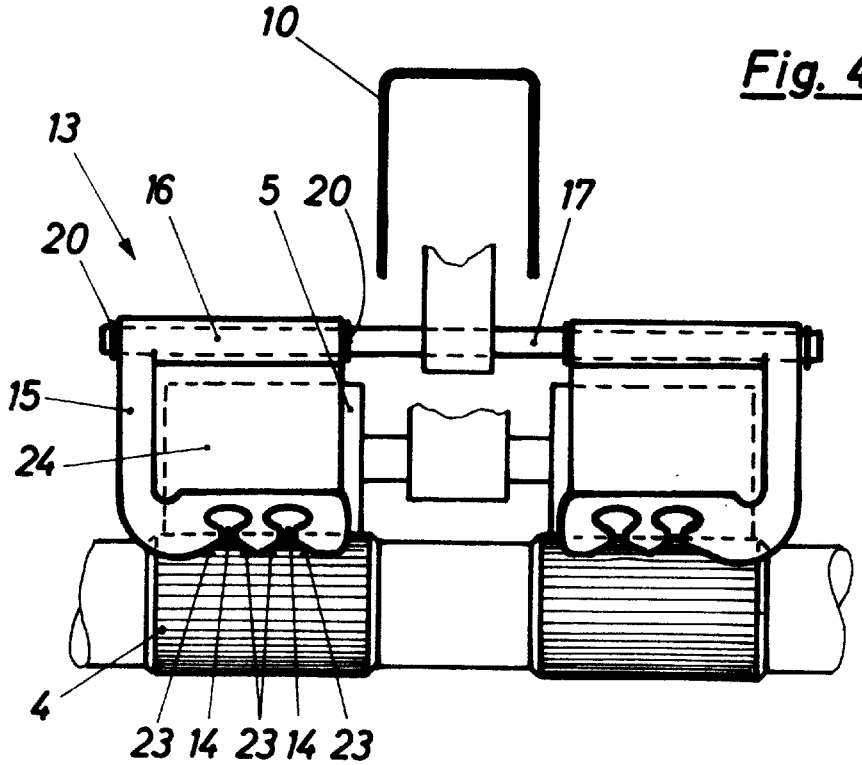
FIG. 4 is another view similar to FIG. 2 with still another configuration of the sliver compactor for a plurality of slivers which are intended to be twisted together.

It will be apparent that the holding arm 15 of one or both of the sliver compactors 13 can also be disposed along the sides of the upper rollers or upper belts which are turned toward one another, i.e. along the inner ends of the two upper rollers 5 of the twinned rollers, rather than along the outer ends as has been shown in FIGS. 3 and 4. However, in this construction sufficient place must be provided the twinned rollers. It is also possible to provide the holding arm of one of the funnels 14 along the outer end of one of the twinned rollers and the holding arm of the other funnel along the inner ends of the twinned rollers. Naturally, the funnels can be mounted with two arms straddling the respective upper roller 5 as has been shown in FIG. 5.

When the drafting frame is placed in operation and the loading arms are swung downwardly and locked, after the sliver has been placed on the lower rollers 4, the lowering of the arms also lowers the funnels 14 of the two part and one piece embodiments to position the funnels along the center line of the nip and to allow the guide edges 23 (FIG. 4) to guide the sliver into the opening of the funnel.

FIG. 4 shows an embodiment of the invention in which each arm 15 supports two funnels 14 for two slivers which pass through the drafting frame for each of the spin twisting stations of the spin twist machine parallel to one another.

The two slivers, after they have been drafted are thus twisted together and spun into a single yarn.

The resulting yarn is similar to one produced by the twisting of previously spun threads and can also be designated as a luster yarn.

The two funnels 14 of each arm can maintain a fixed spacing of the two slivers as they pass through the respective drafting station associated with the twist spinning spindle.

FIG. 4 also shows another feature of the invention, namely, a thin foil 24 which can be a partition extending between the bushing 16 and the portion formed with the funnels 14. This construction stiffens the mount for the funnels.

The partition 24 also has the advantage that fibers do not tend to pass across the upper edge of the body forming the funnels and passed the funnels. In other words, the thin partition has the function of preventing fibers from passing over the funnels without running through them. In this case as well, the body formed with the funnels can be held by one arm or two arms laterally of the upper roller 5 or the upper belt 12. The partition 24 can also be used in the embodiments of FIGS. 3 and 5 where one piece compaction funnels are provided.

We claim:

1. A drafting frame with sliver compaction comprising:

a support mounted upon a textile machine;

at least one loading arm swingably mounted on said support and extending above said support;

a lower belt on said support and an upper belt on said arm for entraining at least one sliver between said belts;

a pair of rollers downstream of said belts and including a lower roller on said support and an upper roller on said arm for engaging sliver from said belts at a nip of said roller;

a sliver compaction funnel receiving sliver from said belts and feeding the sliver into said nip at an upstream side thereof, said funnel converging in a direction of displacement of said sliver between said rollers; and means for mounting said sliver compaction funnel on said loading arm and including a mounting rod extending transversely to said direction and at least one mounting arm swingable on said rod, extending laterally of one said upper roller and said upper belt and engaging said funnel.

2. The drafting frame defined in claim 1 wherein the compaction funnel is formed in two parts and each of said parts is provided with a respective one of said mounting arms connecting the respective part with said mounting rod.

3. The drafting frame defined in claim 1 wherein said funnel is provided in a single piece and is connected with said rod by only one mounting arm.

4. The drafting frame defined in claim 3 wherein said rollers and said belts are twinned so that said loading arm carries two of said pairs of rollers and two of said pairs of belts with respective sliver compaction funnels for each pair of rollers and pair of belts, said mounting arms for said funnels lying along sides of one of said upper rollers and upper belts disposed outwardly from one another.

5. The drafting frame defined in claim 1 wherein said funnel is formed in one piece and a thin partition extends from one piece funnel upwardly in a space between said upper belt and said upper roller.

6. The drafting frame defined in claim 1 wherein said funnel is formed in one piece and has a pair of said mounting arms, each of said mounting arms being formed with a bearing bushing rotatable on said rod, further comprising a grooved roller rotatable on said rod and axially shiftable thereon between said bushings.

7. The drafting frame defined in claim 1 wherein a plurality of funnels are formed on a one piece body supported by said arm.

8. The drafting frame defined in claim 1 wherein said arm is formed with an elongated bushing rotatable on said rod and said funnel is formed on a body provided with a pair of guide edges inclined upwardly and inwardly toward said funnel for guiding said sliver into said funnel.

9. The drafting frame defined in claim 8 wherein said funnel is provided in a body formed on said arm, a thin partition extending between said bushing and said body.

* * * * *